US008246043B2

(12) United States Patent
Wu

(10) Patent No.: US 8,246,043 B2
(45) Date of Patent: Aug. 21, 2012

(54) MEDIA RETRIEVAL MECHANISM AND DRIVING DEVICE THEREOF

(75) Inventor: Chang-Hsiu Wu, Tu-Cheng (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 165 days.

(21) Appl. No.: 12/771,051

(22) Filed: Apr. 30, 2010

(65) Prior Publication Data

US 2011/0227278 A1 Sep. 22, 2011

(30) Foreign Application Priority Data

Mar. 17, 2010 (CN) ..... 2010 1 0125695

(51) Int. Cl.
*B65H 3/06* (2006.01)

(52) U.S. Cl. ..... 271/118; 271/117; 271/116

(58) Field of Classification Search ..... 271/117, 271/118

See application file for complete search history.

(56) References Cited

U.S. PATENT DOCUMENTS

| | | | | |
|---|---|---|---|---|
| 6,817,793 | B2 * | 11/2004 | Kelsay et al. | 400/578 |
| 7,152,858 | B2 * | 12/2006 | Lin | 271/117 |
| 7,530,563 | B2 * | 5/2009 | Kuo | 271/124 |
| 2003/0090053 | A1 * | 5/2003 | Hsiao et al. | 271/118 |

* cited by examiner

*Primary Examiner* — Michael McCullough
*Assistant Examiner* — Howard Sanders
(74) *Attorney, Agent, or Firm* — Altis Law Group, Inc.

(57) ABSTRACT

A media retrieval mechanism includes a pivot shaft, a media delivery device and a driving device. The media delivery device is capable of rotating about the pivot shaft. The media delivery device includes a contact portion and a rotating arm. The contact portion is capable of engaging at least one media. The driving device is attached to the pivot shaft. The driving device is capable of being driven by the pivot shaft. The driving device includes a driving member and the driving member includes a driving arm. The driving arm is capable of directing the rotating arm to angle the media delivery device thereby elevating the contact portion from the lower position to a lift-up position for disengaging the at least one media.

8 Claims, 6 Drawing Sheets

MEDIA RETRIEVAL MECHANISM AND DRIVING DEVICE THEREOF

BACKGROUND

1. Technical Field

The present disclosure relates to media retrieval mechanisms, and more particularly to a media retrieval mechanism for a printer and a driving device used in the media retrieval mechanism.

2. Description of Related Art

In computing, following completion of a print job, remaining media may need to be retrieved from a media cartridge. However, a delivery arm of a typical printer may obstruct such retrieval.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
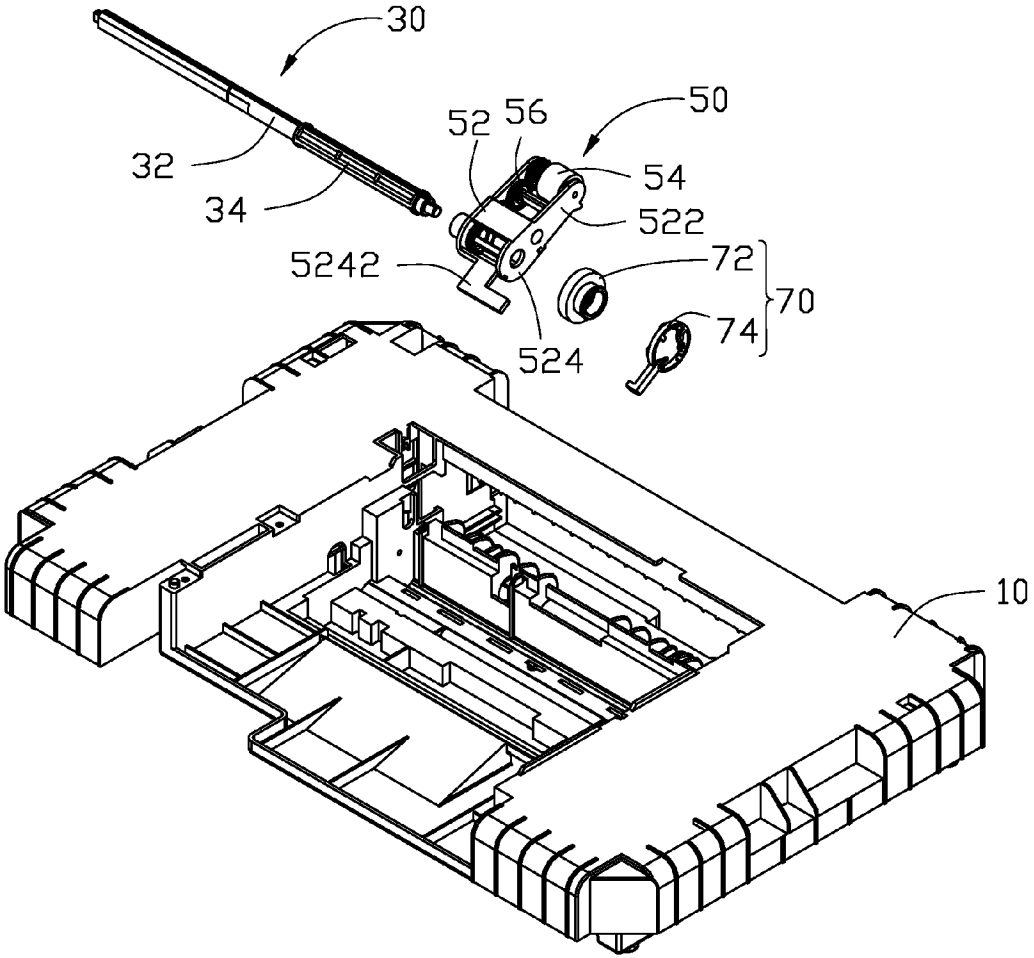
FIG. 1 is an exploded, isometric view of an embodiment of a media retrieval mechanism.

Referring to FIG. 1, an embodiment of a media retrieval mechanism includes a chassis 10, a pivot shaft 30, a media delivery device 50 and a driving device 70.

The pivot shaft 30 includes a driving shaft 34 and a media delivery shaft 32. The media delivery device 50 can rotate relative to the media delivery shaft 32. The driving shaft 34 has a cross-shaped cross section.

The media delivery device 50 retrieves media from a media cartridge (not shown). The media delivery device 50 includes a cover 52, a roller 54 and a gear assembly 56. The cover 52 includes a pivot portion 524 and a contact portion 522. The pivot portion 524 is around the media delivery shaft 32. The roller 54 is mounted to the contact portion 522. An L-shaped rotating arm 5242 is located on the cover 52 away from the contact portion 522. The media may be printing paper.

Figure 2:
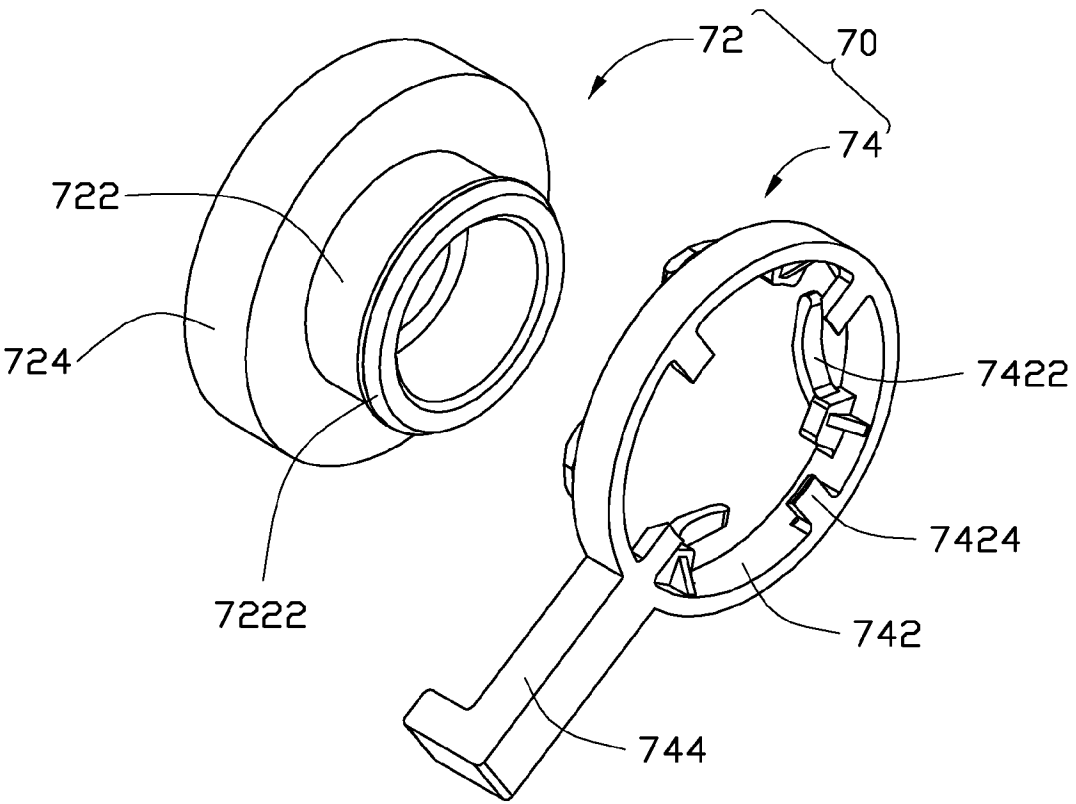
FIG. 2 is an enlarged view of a disclosed driving device of a media retrieval mechanism such as, for example, that of FIG. 1.

FIG. 2 is an enlarged view of a driving device 70 of a media retrieval mechanism such as, for example, that of FIG. 1, the driving device 70 including a sleeve 72 and a driving member 74. The sleeve 72 is engaged with and movable by the driving shaft 34. The sleeve 72 includes a circular mounting portion 722 and a circular extending portion 724. A diameter of the extending portion 724 exceeds that of the mounting portion 722. A flange 7222 protrudes from the mounting portion 722 away from the extending portion 724. The driving member 74 includes a body 742 and an L-shaped driving arm 744. A plurality of resilient contact legs 7422 is located on the body 742 extending towards the extending portion 724. A plurality of supporting feet 7424 protrudes from the body 742 towards the mounting portion 722. Each of the plurality of the supporting feet 7424 has a cuneiform end portion.

Figure 3:
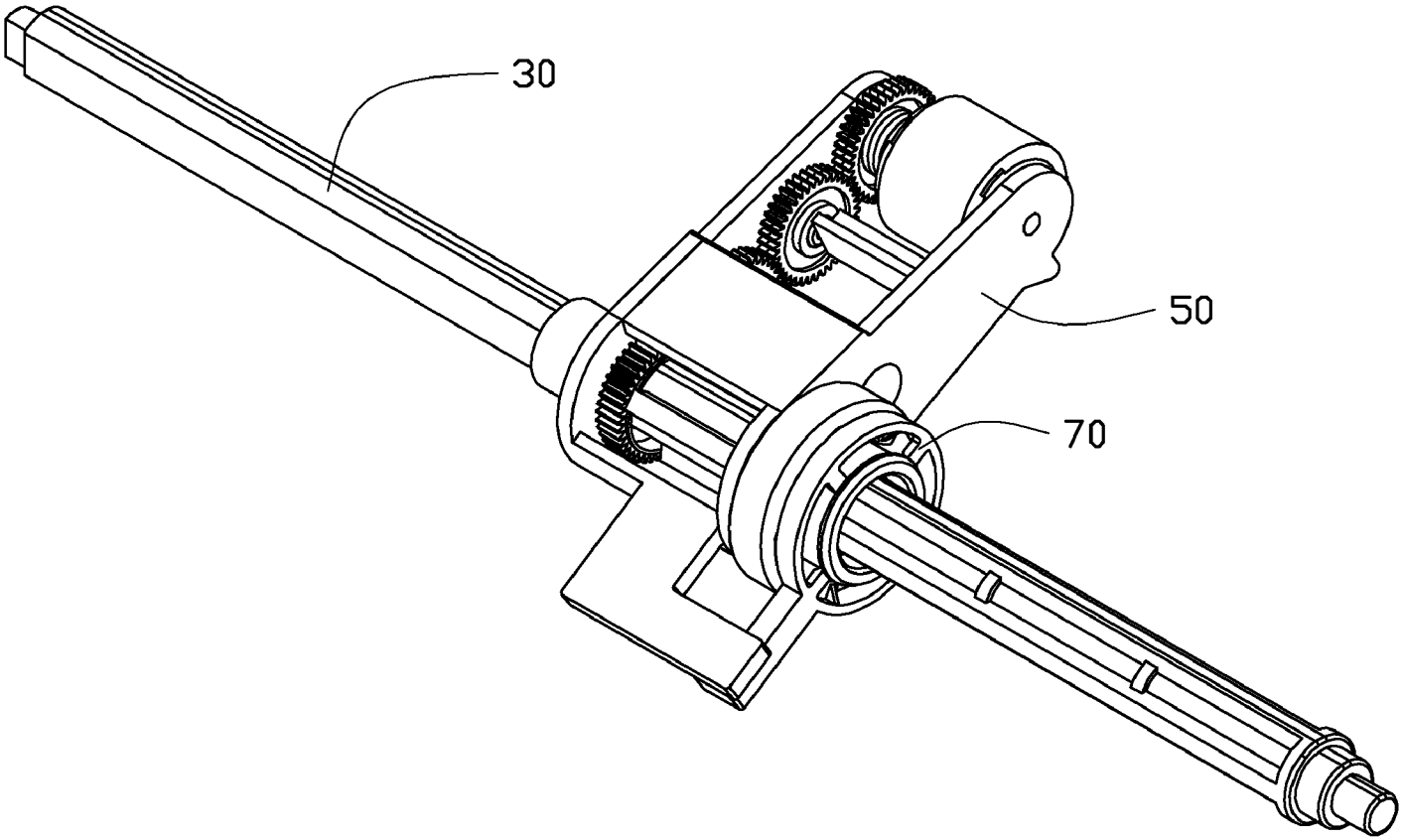
FIG. 3 is an assembled view of a driving device, pivot shaft and media delivery device of the media retrieval mechanism of FIG. 1.

Referring to FIG. 3, during assembly of the media retrieval mechanism, the driving member 74 is mounted to the sleeve 72. The contact legs 7422 abut the extending portion 724 and lateral sides of the supporting feet 7424 abut the flange 7222 so that the body 742 is held on the sleeve 72. The driving device 70 is mounted to driving shaft 34 and the media delivery device 50 is mounted to the media delivery shaft 32.

Figure 4:
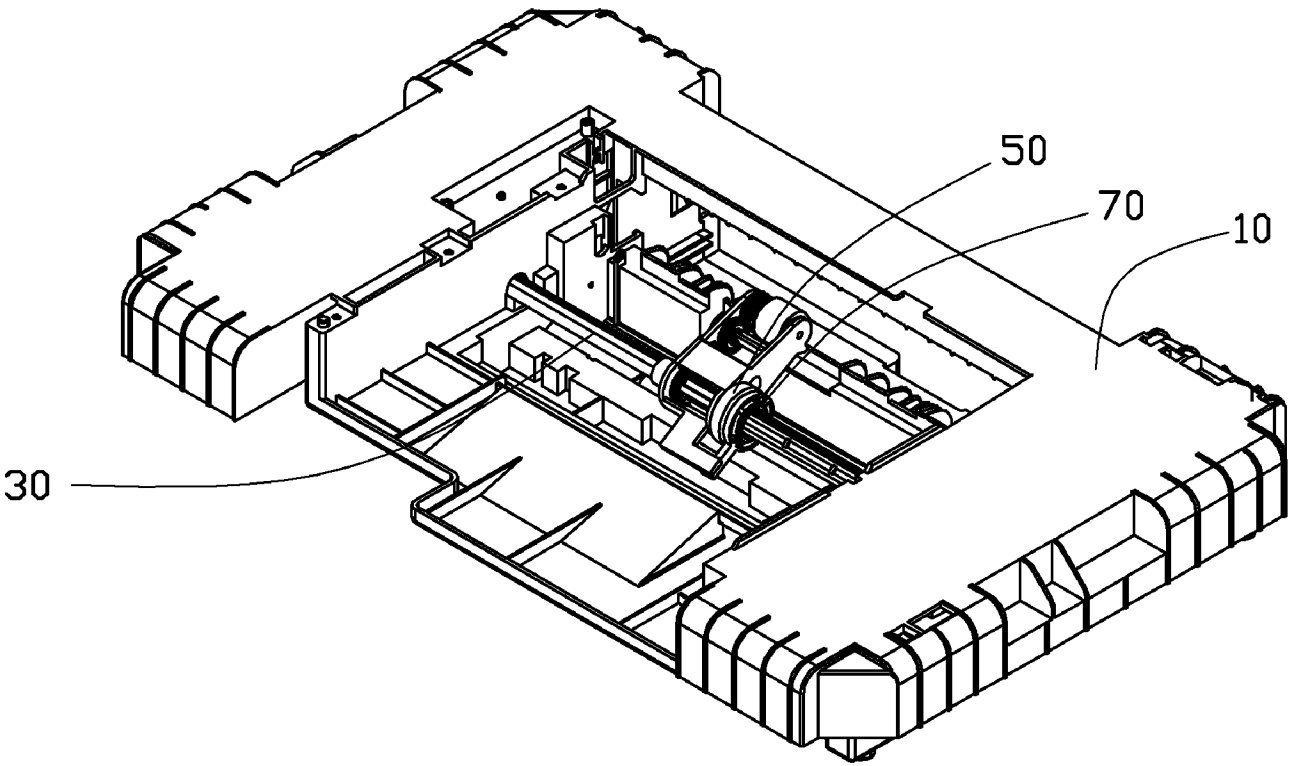
FIG. 4 is an assembled view of the media retrieval mechanism of FIG. 1.

Referring to FIG. 4, the media retrieval mechanism is fixed to the chassis 10 and the pivot shaft 30 may rotate relative to the chassis 10. An end of the driving shaft 34 may be connected to a driving motor (not shown).

Figure 5:
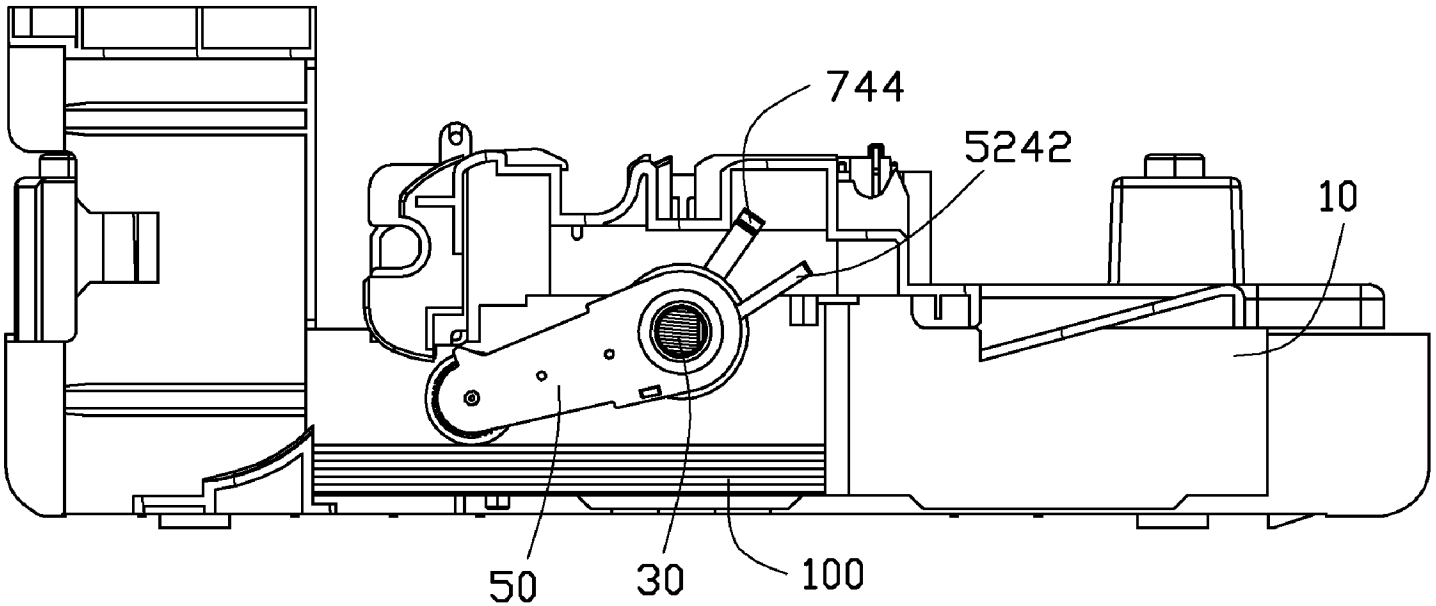
FIG. 5 is a schematic view of the media retrieval mechanism of FIG. 1 showing the media delivery device in a holding state.
Figure 6:
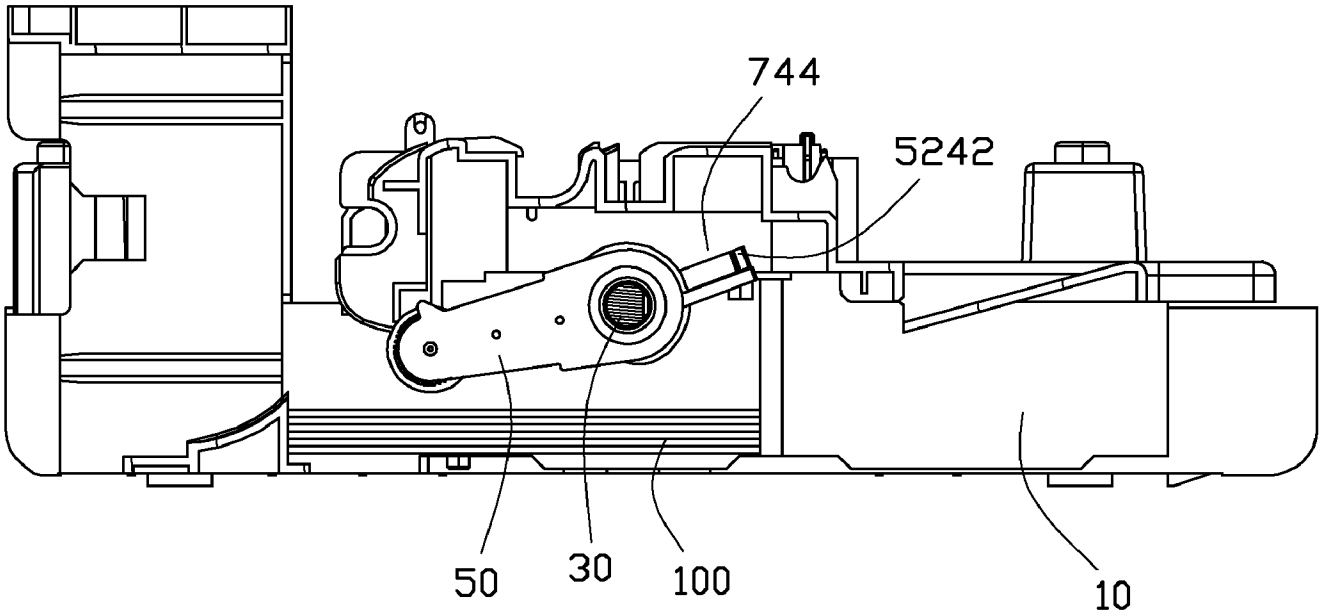
FIG. 6 is similar to FIG. 5, but shows the media delivery device tilted.

Referring to FIG. 5, during use, a plurality of media 100 is held by the contact portion 522 of the media delivery device 50 and the media delivery device 50 is placed in a holding state. The driving shaft 34 is rotated by the driving motor and the driving device 70 rotates accordingly. Further referring to FIG. 6, the driving arm 744 contacts the rotating arm 5242 and tilts the media delivery device 50. The contact portion 522 is elevated and moves away from the media 100, which can be freely retrieved from the chassis 10. When the driving device 70 is released, the contact portion 522 may return to the holding state.

It is also to be understood, however, that even though numerous characteristics and advantages have been set forth in the foregoing description of the embodiments, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A media retrieval mechanism comprising:

a pivot shaft;

a media delivery device capable of rotating about the pivot shaft, the media delivery device comprising:

a contact portion capable of engaging at least one media; and a rotating arm; and a driving device attached to the pivot shaft, the driving device capable of being driven by the pivot shaft, the driving device comprising a driving member and the driving member comprising a driving arm;

wherein the driving arm is capable of pressing the rotating arm to angle the media delivery device, thereby elevating the contact portion from a lower position to a lift-up position for disengaging the at least one media, the driving device further comprises a sleeve capable of being driven by the pivot shaft, the driving member is engaged with the sleeve, the sleeve comprises a circular mounting portion and a circular extending portion, a diameter of the circular mounting portion is less than that of the circular extending portion, and the driving member is engaged with the circular mounting portion, the driving member further comprises a circular body, a plurality of resilient contact legs on the circular body and extending towards the circular extending portion, a flange protruding from the circular mounting portion away from the circular extending portion, the circular body is held between the circular extending portion and the flange.

2. The media retrieval mechanism of claim 1, wherein a plurality of supporting feet protrudes from the circular body towards the circular mounting portion, and lateral sides of the plurality of supporting feet abut the flange.

3. The media retrieval mechanism of claim 2, wherein each of the plurality of supporting feet comprises a cuneiform end portion.

4. A driving device for a media retrieval mechanism, the driving device comprising:

a sleeve driven by a pivot shaft; and a driving member fixed around the sleeve, the driving member comprising a driving arm;

wherein the driving arm is capable of angling a contact portion of a media delivery device; the sleeve comprises a circular mounting portion and a circular extending portion, a diameter of the circular mounting portion is less than that of the circular extending portion, and the driving member is fixed around the circular mounting portion; the driving member further comprises a circular body; a plurality of resilient contact legs is located on the circular body and extends towards the circular extending portion, a flange protrudes from the circular mounting portion away from the circular extending portion, and the circular body is held between the circular extending portion and the flange.

5. The driving device for a media retrieval mechanism of claim 4, wherein a plurality of supporting feet protrudes from the circular body towards the circular mounting portion, and lateral sides of the plurality of supporting feet abut the flange.

6. The driving device for a media retrieval mechanism of claim 5, wherein each of the plurality of supporting feet comprises a cuneiform end portion.

7. The driving device for a media retrieval mechanism of claim 4, wherein the driving arm is L-shaped.

8. A media retrieval mechanism comprising:

a media delivery device comprising a rotating arm and a contact portion for engaging at least one media;

a pivot shaft extending through the media delivery device, the media delivery device being adapted to rotate relative to the pivot shaft, and the rotating arm and the contact portion being on substantially opposite sides of the pivot shaft; and a driving device attached to and driven by the pivot shaft, the driving device comprising a driving arm;

wherein the driving arm is rotated by the pivot shaft to urge the rotating arm to elevate the contact portion from a lower position to a lift-up position, the driving device further comprises a sleeve attached to the pivot shaft and a driving member attached to the sleeve, and the driving arm is located on the driving member, the sleeve comprises a circular mounting portion and a circular extending portion, a diameter of the circular mounting portion is less than a diameter of the circular extending portion, and the driving member is engaged with the circular mounting portion, the driving member is fixed around the circular mounting portion, the driving member further comprises a circular body, a plurality of resilient contact legs on the circular body and extending towards the circular extending portion, a flange protruding from the circular mounting portion away from the circular extending portion, and the circular body is held between the circular extending portion and the flange.

* * * * *